US007357135B2

(12) United States Patent
Cunningham et al.

(10) Patent No.: US 7,357,135 B2
(45) Date of Patent: Apr. 15, 2008

(54) PROTECTIVE HOOD WITH FAN ASSEMBLY

(75) Inventors: Jerry Cunningham, Covington, IN (US); Tom Frey, Clinton, IN (US)

(73) Assignee: Steel Grip, Inc., Danville, IL (US)

( * ) Notice: Subject to any disclaimer, the term of this patent is extended or adjusted under 35 U.S.C. 154(b) by 601 days.

(21) Appl. No.: 10/936,394

(22) Filed: Sep. 8, 2004

(65) Prior Publication Data

US 2006/0048776 A1 Mar. 9, 2006

(51) Int. Cl.
*A62B 17/04* (2006.01)
*A62B 18/00* (2006.01)
*A62B 17/00* (2006.01)

(52) U.S. Cl. ..... 128/201.22; 128/201.23; 128/201.29

(58) Field of Classification Search ..... 128/201.22–201.25, 201.29; 2/171.3–171.4, 2/8.1, 8.2, 410, 422, 457–458
See application file for complete search history.

(56) References Cited

U.S. PATENT DOCUMENTS 3,467,965 A 9/1969 Murphy
3,762,407 A * 10/1973 Shonerd ..... 128/201.23
3,963,021 A * 6/1976 Bancroft ..... 128/201.25
4,019,508 A 4/1977 Der Estephanian et al.
4,195,363 A 4/1980 Jenson
4,744,106 A * 5/1988 Wang ..... 2/7
4,901,716 A * 2/1990 Stackhouse et al. ... 128/201.25
4,965,887 A 10/1990 Paoluccio et al.
5,054,480 A 10/1991 Bare et al.
5,113,854 A * 5/1992 Dosch et al. ..... 128/201.23
5,283,914 A * 2/1994 James ..... 2/424
H1360 H 10/1994 Grove et al.
5,592,936 A * 1/1997 Thomas et al. ..... 128/206.12
5,655,374 A * 8/1997 Santilli et al. ..... 62/3.5
5,711,033 A * 1/1998 Green et al. ..... 2/171.3
5,878,742 A 3/1999 Figueredo et al.
5,887,276 A 3/1999 Lee
6,014,971 A 1/2000 Danisch et al.
6,513,168 B2 * 2/2003 Paris et al. ..... 2/171.3
6,763,835 B1 * 7/2004 Grove et al. ..... 128/857
6,925,655 B1 * 8/2005 Maki et al. ..... 2/171.3
6,973,677 B2 * 12/2005 Diaz et al. ..... 2/171.3
7,192,151 B2 * 3/2007 Clupper et al. ..... 362/105
2001/0037519 A1 11/2001 Paris et al.
2003/0111074 A1 * 6/2003 Alon et al. ..... 128/201.22
2003/0182711 A1 10/2003 Klotz et al.

* cited by examiner

*Primary Examiner*—Justine R. Yu
*Assistant Examiner*—Kristen C. Matter
(74) *Attorney, Agent, or Firm*—Woodard, Emhardt, Moriarty, McNett & Henry LLP

(57) ABSTRACT

The present system includes a protective hood with a vent opening and a transparent shield mounted to a front portion of the hood. In a basic configuration, a fan assembly is removably mounted to the hood and coupled to the vent opening to direct airflow within the hood. In another configuration, a fan assembly is selectively attachable to the vent opening or position. Optionally, a rear flap selectively seals the vent position when the fan assembly is detached and the rear flap partially covers a fan when the fan assembly is attached to the hood. In another configuration, a fan assembly is detachably mounted to the hood to draw an airflow into the hood. In preferred embodiments, a wearer can wear the hood with the fan assembly attached or detached.

27 Claims, 8 Drawing Sheets

PROTECTIVE HOOD WITH FAN ASSEMBLY

FIELD OF THE INVENTION

The present invention relates to a protective hood with a fan assembly, and more particularly to a system usable in various configurations, for example for selectively attaching a fan assembly to a protective hood and/or for selectively directing the airflow.

BACKGROUND OF THE INVENTION

Hood devices are often worn for protection in various industries, such as, the metal working industry, the chemical industry, and/or the medical industry. Hoods can be made of protective materials. For example, hoods can protect the wearer from such conditions as high temperatures, dangerous chemicals or materials, and/or a contaminated environment.

Certain types of hoods form a seal from the outside environment to protect the wearer from this environment. A sealed hood provides limited access to the inside of the hood on the wearer's head. Body heat and perspiration from the wearer can build up within the sealed hood and can cause discomfort for the wearer and even fog within the hood that limits the wearer's view outside the hood.

Sometimes, a ventilation system is incorporated into the hood to provide fresh airflow within the hood for the user and/or for cooling the user. Powering a ventilation system can be difficult as the ventilation system can require electrical cords connecting a power source to the ventilation system. The user can be limited in his/her movement by the length of the electrical cords and/or the electrical cords can tangle.

Optionally, some users may purchase two protective hoods. A first hood without a ventilation system and a second hood with a ventilation system. The purchase of two hoods can be expensive.

There is a need for an improved protective hood and fan assembly. Certain embodiments of the present invention address these and other needs.

SUMMARY OF THE INVENTION

The present system includes a protective hood that defines a vent opening in a rear portion of the hood. A transparent shield is mounted to a front portion of the hood. A fan assembly includes a fan to generate an airflow.

In one embodiment, the fan assembly is removably mounted to the hood and coupled to the vent opening to direct airflow within the hood. Preferably, the protective hood has a rear flap for sealing the vent opening when the fan assembly is removed from the hood. Optionally, when the fan assembly is mounted to the protective hood, the rear flap partially defines a pathway for an airflow to or from the fan. In certain preferred embodiments, the system includes a power source for operating the fan.

In an alternate embodiment, the fan assembly is selectively attachable to the vent opening or a vent position to cause airflow within the hood. A rear flap selectively seals the vent position when the fan assembly is detached and the rear flap partially covers the fan when the fan assembly is attached to the hood. Preferably, the fan assembly has a pocket to store a power source to operate the fan. Optionally, the protective hood can be mounted over a helmet.

In yet another embodiment, the fan assembly is detachably mounted to the hood near the vent opening. The fan has a plurality of blades and a motor for rotating the plurality of blades to draw an airflow into the hood or exhaust an airflow. The airflow may be drawn or exhausted in a downward direction. Preferably, the fan assembly defines an intake pathway to direct the inward flow of air.

In another alternate embodiment, the fan assembly has a base and the base and fan are mounted on the hood near the vent opening. The fan provides a flow of air in an inward direction through the opening. A flap is mounted to the rear portion of the hood and extends at least partially over the fan assembly and the opening such that the flap directs the flow of air.

It is an object of certain embodiments of the present invention to provide a protective hood with a fan assembly.

Further objects, features and advantages of the present invention shall become apparent from the detailed drawings and descriptions provided herein.

BRIEF DESCRIPTION OF PREFERRED EMBODIMENTS

Figure 1:
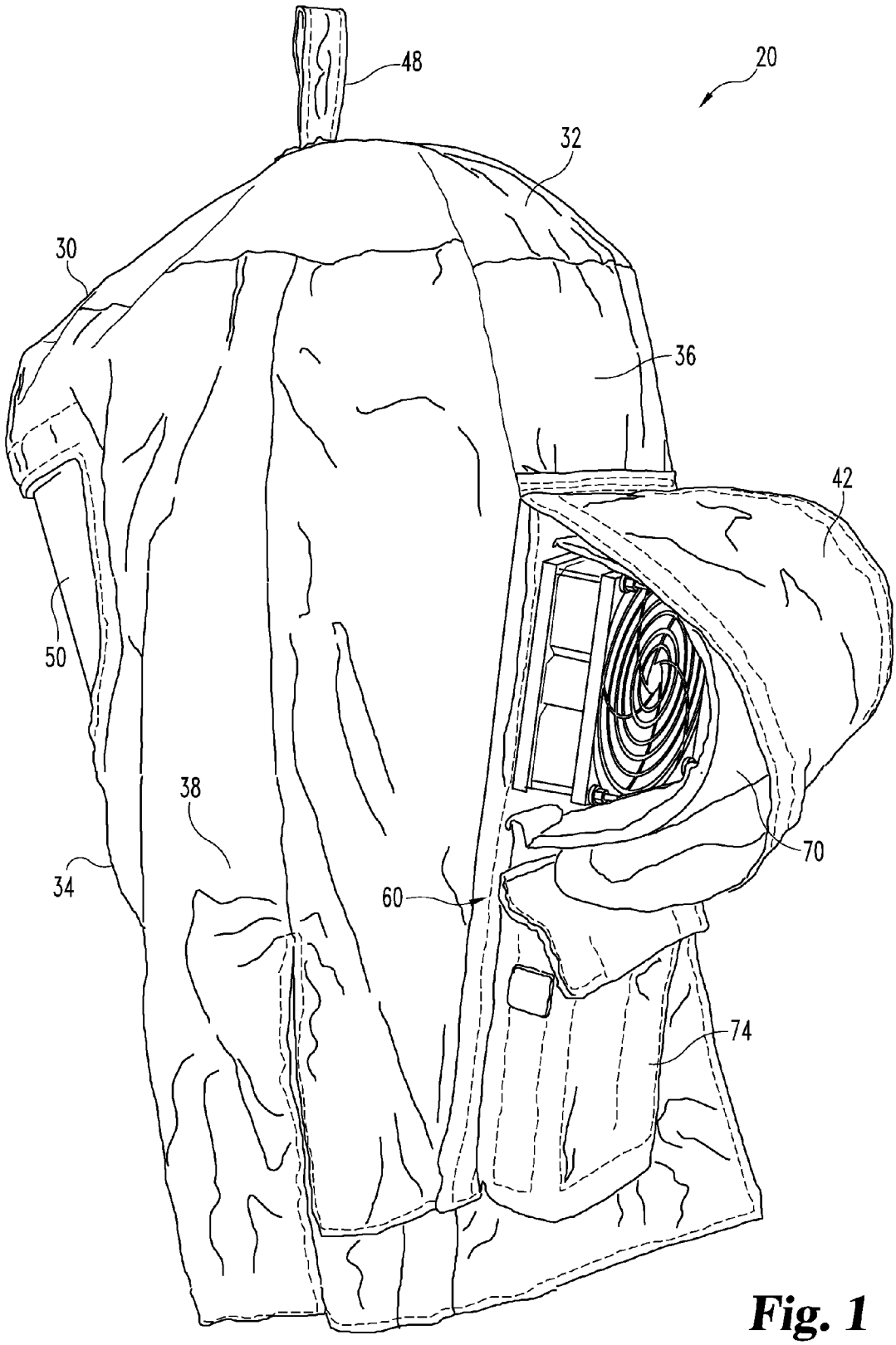
FIG. 1 is a perspective side view of one preferred embodiment of the present invention.

While the present invention may be embodied in many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

The present system includes a protective hood having at least front and rear portions for surrounding the corresponding areas of a wearer's head. The protective hood defines a vent opening in the rear portion of the hood. A transparent shield is typically mounted to the front portion of the hood.

A basic configuration includes the present system and a fan assembly removably mounted to the protective hood and coupled to the vent opening to direct airflow within the hood. The fan assembly typically has a fan with a hub and a plurality of blades and a motor for rotating the plurality of blades in a path of movement so as to generate a flow of air within the hood. Preferably, the fan introduces air into the hood, although alternatively the fan draws air outward from within the hood.

As should be appreciated, the mountability of the fan assembly to the protective hood gives the wearer the option whether to attach the fan assembly to the protective hood or to wear the protective hood without the fan assembly. Optionally the protective hood has a rear flap to cover and seal the vent opening when the fan assembly is removed from the hood. Also optionally, the rear flap partially covers the fan to define a pathway for an inward airflow from the fan in a direction toward the wearer, or an outward airflow from the fan in a direction away from the wearer, such as sideways or downward, when the fan assembly is mounted to the protective hood. Preferably, the fan assembly includes a portion to direct the airflow to or from the fan.

In another basic configuration, the present system includes a fan assembly having a fan selectively attachable to the vent position or opening to cause airflow within the hood. A rear flap either selectively seals the vent position when the fan assembly is detached or the rear flap partially covers the fan when the fan assembly is attached to the protective hood. As should be appreciated, the rear flap protects the user and those persons near the user. For example, when the fan assembly is detached from the hood, the rear flap seals the vent position to protect the back of the wearer's head. Preferably, the fan assembly has a power source connectable to a motor that operates the fan. Optionally, the fan assembly has a pocket to store the power source. In one option, the protective hood can be mounted over a helmet that is configured to rest on a wearer's head.

A perspective view of a protective system according to one preferred embodiment of the present invention is illustrated in FIG. 1. The protective system 20 includes hood 30, transparent shield 50, and fan assembly 60. As illustrated, hood 30 has generally a circular, cross-section with a top surface 32, a front surface 34, a rear surface 36 and generally vertical and parallel side surfaces 38. Alternate geometric cross-sections such as oval, rectangular, or square, to name a few for hood 30 can be used as desired. Hood 30 further defines a cavity 40 (shown in FIG. 5) bound by the top surface 32, the front surface 34, the rear surface 36, and the side surfaces 38. Cavity 40 is sized to fit a person's head.

Figure 2:
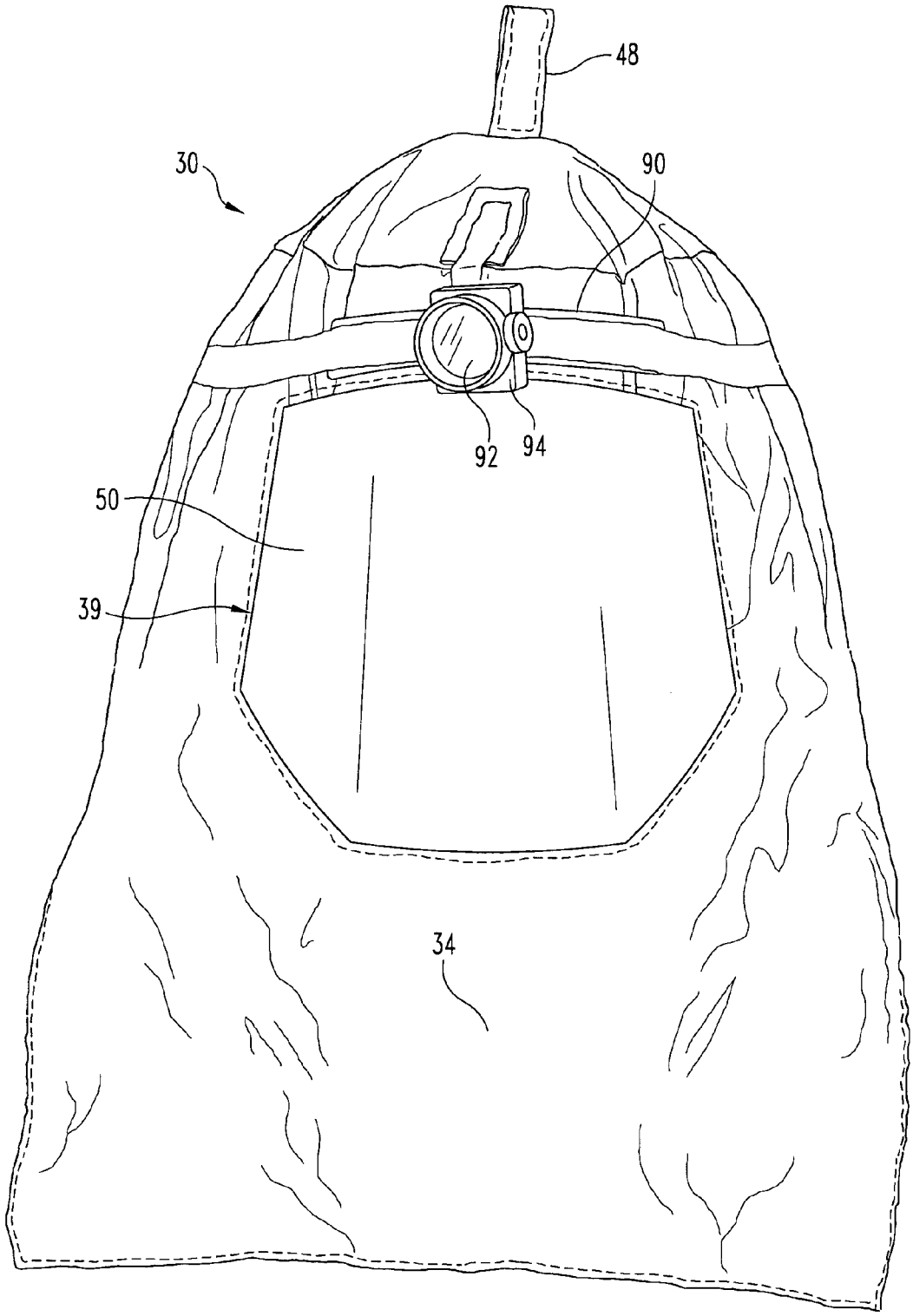
FIG. 2 is a front view of another preferred embodiment of the present invention.

In one form, top surface 32, front surface 34, rear surface 36, and side surfaces 38 form rounded corners at their connection. As shown in FIG. 2, front surface 34 includes a shield opening 39 for receiving transparent shield 50. In one form, hood 30 is constructed of layers of Kevlar® barrier material (or other synthetic fiber for use in protective ballistic clothing or protective fire clothing) sandwiched between layers of Nomex® fibers (or other synthetic fiber for use in protective clothing or protective fire clothing). In this form, hood 30 is a multi-layered, lightweight, and flexible material. Various materials may be used to form hood 30, such as, woven fabric, non-woven fabric, or a variety of natural or synthetic fibers.

Figure 3:
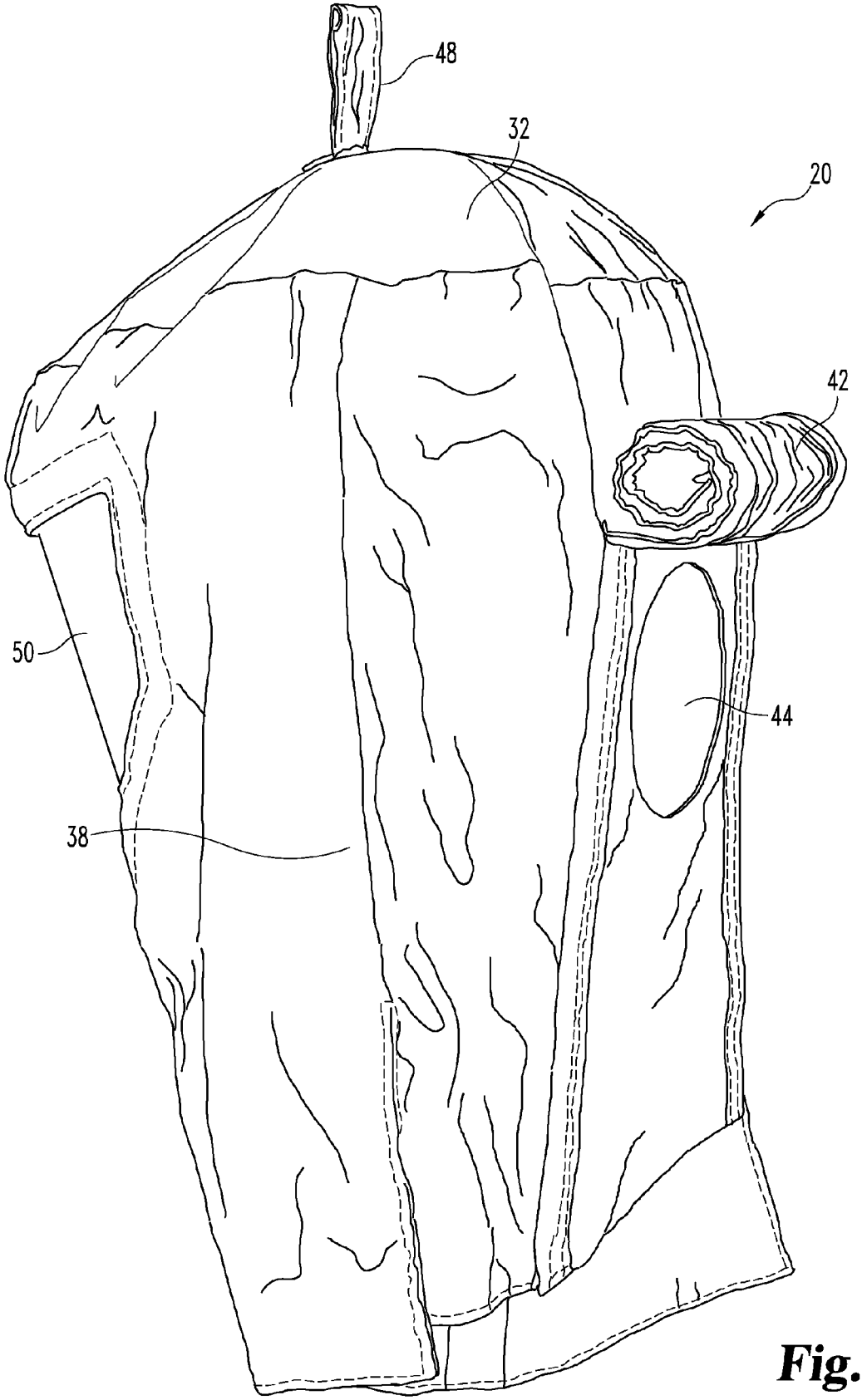
FIG. 3 is a perspective side view of the embodiment of FIG. 1 without the fan assembly.
Figure 4:
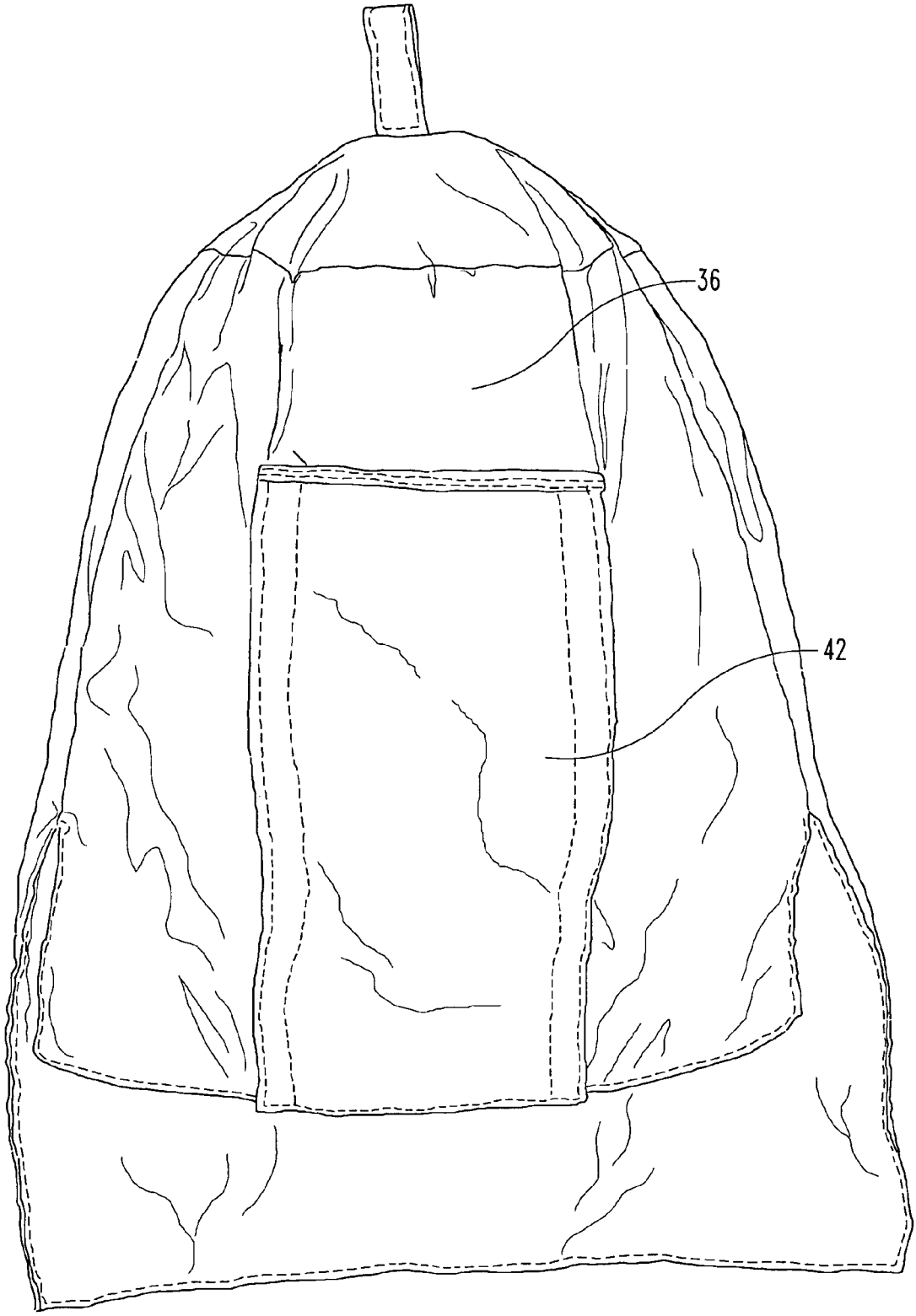
FIG. 4 is a rear view of the embodiment of FIG. 1 without the fan assembly.
Figure 8:
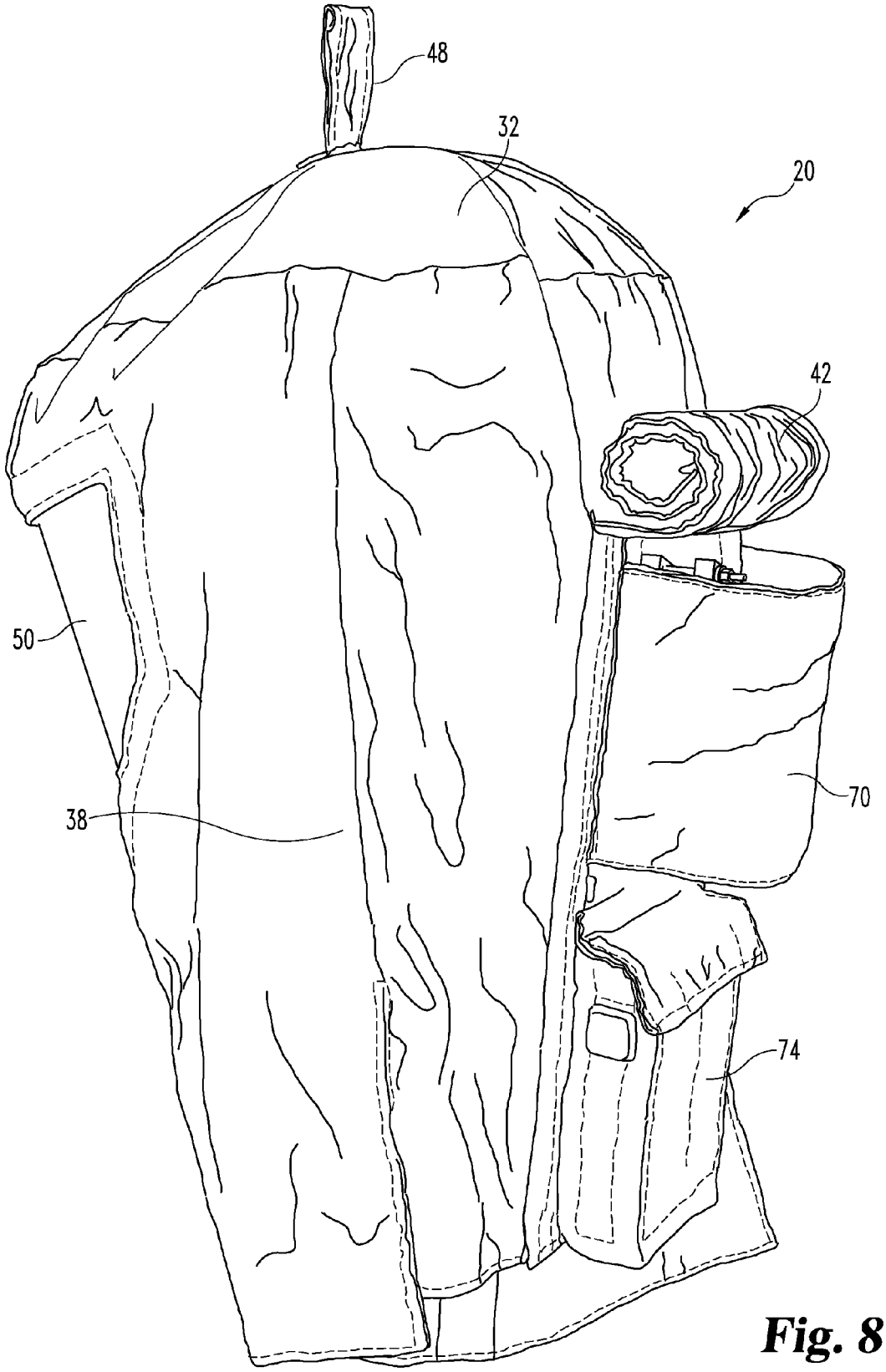
FIG. 8 is a perspective side view of another preferred embodiment of the present invention.

In the embodiment illustrated in FIG. 1, hood 30 includes a rear flap 42. As illustrated, rear flap 42 has a generally rectangular shape. Alternate geometric shapes such as circular, oval, or square, to name a few for rear flap 42 can be used as desired. Hood 30 further includes a vent opening 44 in rear surface 36 as illustrated in FIG. 3. Rear flap 42 can cover and seal the vent opening 44 when the fan assembly 60 is removed from the hood 30 as shown in FIG. 4. Rear flap 42 can seal the vent opening 44 with a connection mechanism, examples include a clip, a zipper, a Velcro® fastener strap (hook and loop engaging mechanism), or a snap-in mechanism. Preferably the rear flap 42 is constructed from the same material as the hood 30. Alternately, the rear flap 42 can bend or roll up such that the vent opening 44 is clear from any obstruction of the rear flap 42 (as shown in FIG. 3). An attachment mechanism can be used to attach the rolled up rear flap 42 to the rear surface 36. In another form, rear flap 42 is constructed from a material which is fixed in place to cover vent opening 44 as illustrated in FIG. 8.

As illustrated in FIG. 3, hood 30 includes a vent opening 44 for preferably intaking a flow of air into the cavity 40. In the illustrated embodiment, vent opening 44 is a circular shape; however, alternate geometric shapes such as oval, square, rectangular, or trapezoidal, to name a few for vent opening 44 can be used as desired. An example diameter for vent opening 44 is approximately four inches; alternate sizes for vent opening 44 can be used as desired.

Figure 5:
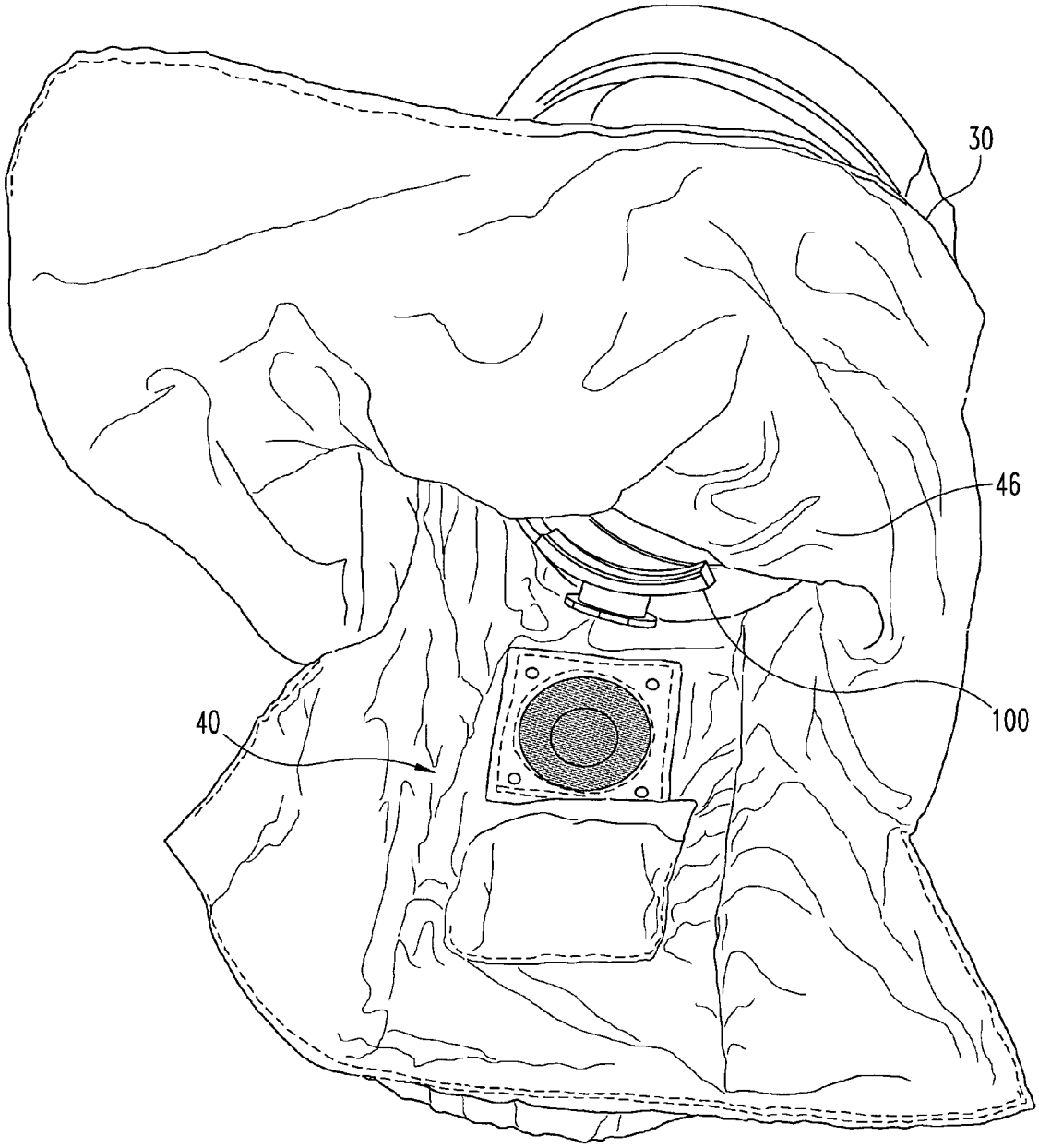
FIG. 5 is a perspective view of an alternate preferred embodiment of the present invention.

In a preferred embodiment, hood 30 can be worn over a helmet 100. As illustrated in FIG. 5, hood 30 includes a helmet engaging surface 46 defined by cavity 40. In this form, helmet engaging surface 46 fits over helmet 100 as shown in FIG. 5. In another form, helmet engaging surface 46 fits directly over a wearer's head.

Figure 6:
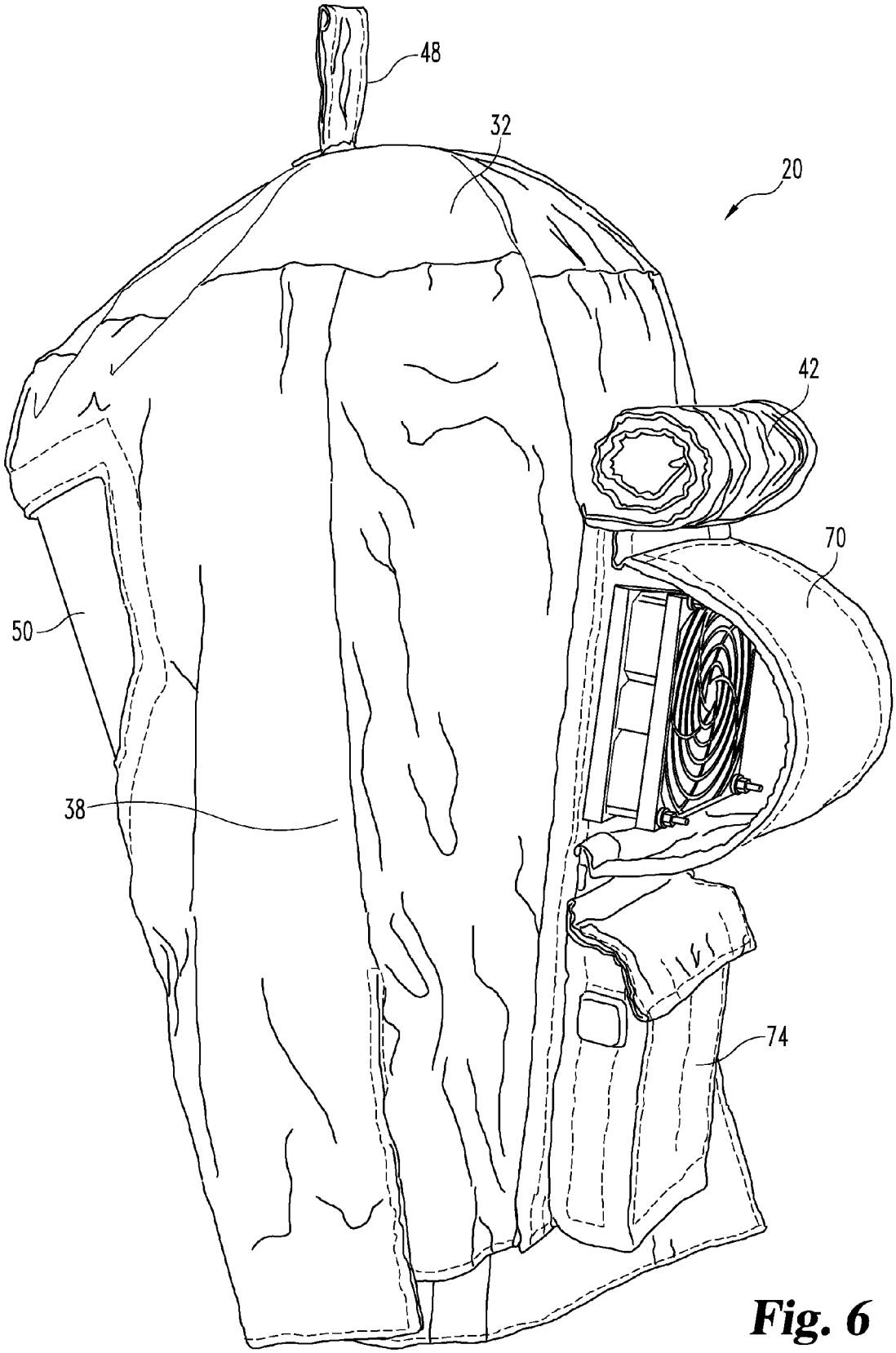
FIG. 6 is a perspective side view of another preferred embodiment of the present invention.

In one embodiment, illustrated in FIG. 6, hood 30 includes a handle 48 for carrying hood 30. Preferably handle 48 is constructed from the same material as the hood 30; however, handle 48 can be constructed from a material different than hood 30.

Transparent shield 50, as illustrated in FIG. 2, is preferably a rounded trapezoid or rectangle in shape and is mounted onto front surface 34 of hood 30. Alternate geometric shapes such as circular, oval, or square, to name a few for transparent shield 50 can be used as desired. Preferably transparent shield 50 has an arched or curved cross-sectional shape. As should be appreciated, in other embodiments, transparent shield 50 can have a flat cross-sectional shape. In one form, shield 50 is constructed of plastic or another material that withstands heat or the desired environment. For one example, transparent shield 50 can preferably withstand 40 cal/cm$^2$ Arc Rating (although the incident energy produced near the transparent shield 50 is expected to be less than 40 cal/cm$^2$). In an alternate form, shield 50 could be made of metal with an opening or slot for the wearer to see. In another form transparent shield 50 is tinted; however, transparent shield 50 can also be translucent. Transparent shield 50 can be permanently or selectively attached to the front surface 34 by various connections such as a Velcro® fastener or a snap-in mechanism, to name a few.

Figure 7:
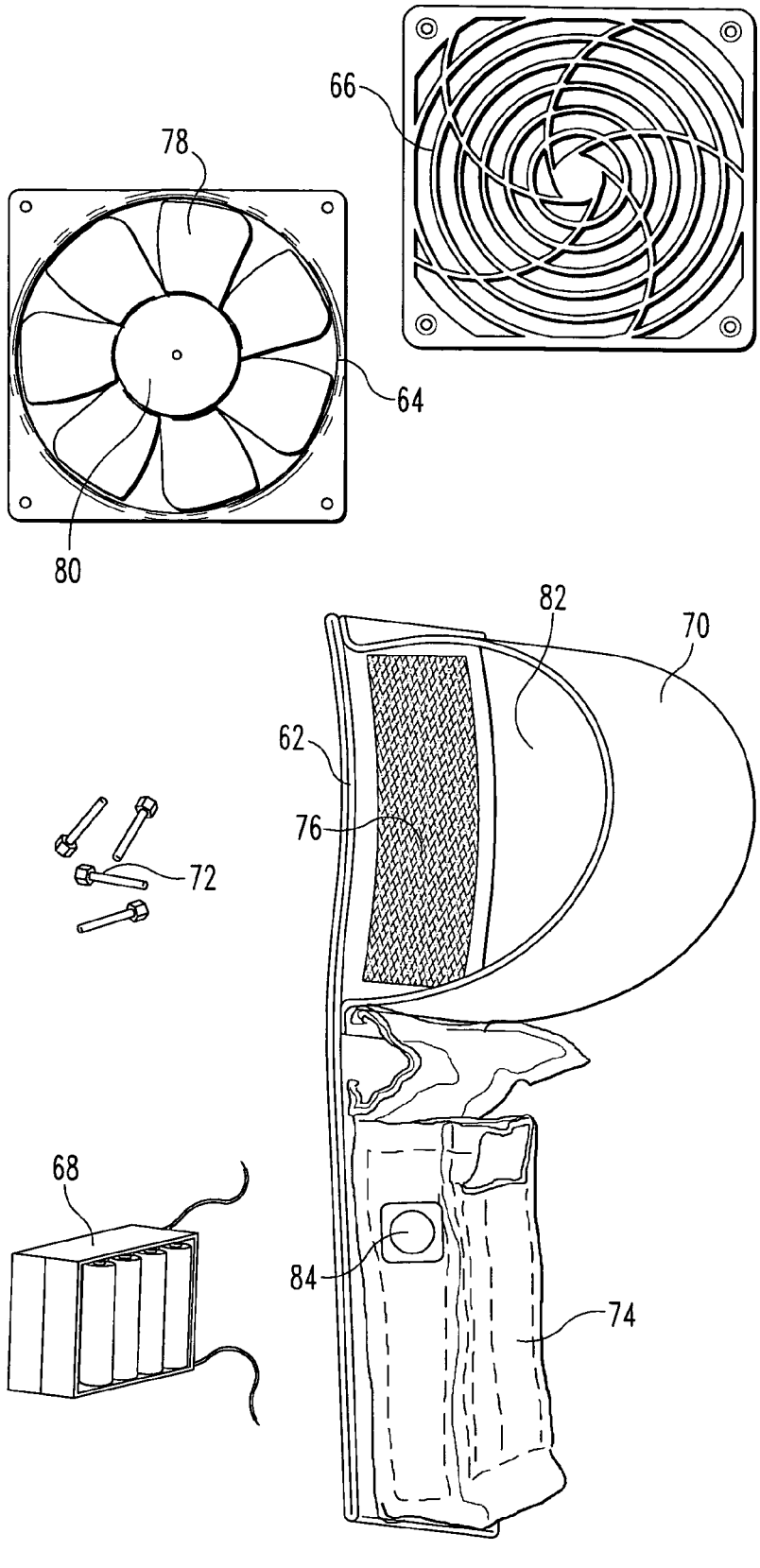
FIG. 7 is an exploded view of a fan assembly of FIG. 1.

One embodiment of a fan assembly 60, as illustrated in FIG. 7, includes base 62, fan 64, protective cover 66, power source 68, fan guard 70, and fan attachment 72. The base 62 has a rectangular shape. Base 62 is preferably mountable on hood 30 to cover the vent opening 44. Alternate geometric shapes such as circular, oval, or square, to name a few for base 62 can be used as desired. Base 62 is preferably constructed of layers of Kevlar® barrier materials sandwiched between layers of Nomex® material similar to hood 30. However, base 62 can be constructed from other materials such as a woven fabric, non-woven fabric or natural or synthetic fibers. Base 62 is selectively attached to hood 30 and coupled to vent opening 44 with a clip, a zipper, a Velcro® fastener strap, or a snap-in mechanism to name a few attachment types.

As illustrated in FIGS. 6 and 7, base 62 preferably includes a pocket 74 for receiving and storing a power source 68. Power source 68 preferably includes batteries stored in a battery holder (discussed below). Pocket 74 is preferably the same shape and preferably larger than the cross-sectional size of power source 68. As shown, pocket 74 is rectangular in shape. Alternate geometric shapes, such as circular or oval, can be used as desired.

Preferably, as illustrated in FIG. 7, base 62 includes a vented area 76. Fan 64 is preferably mounted over vented area 76. As illustrated, vented area 76 is a rectangular shape and preferably of substantially the same cross-sectional size as fan 64. Alternate geometric shapes such as circular, square, or trapezoidal, for vented area 76 can be used as desired. As should be appreciated, vented area 76 separates the cavity 40 from the fan 64. For example, vented area 76 blocks the wearer's hair from becoming tangled in the fan 64 and the vented area 76 also blocks the wearer from encountering outside debris. Fan 64 is permanently or selectively attached to the vented area 76 with fan attachment 72. Fan attachment 72 can include rivets, nuts and bolts, clips or snap-in mechanisms, to name a few types of attachment, to attach the fan 64 to the base 62.

Fan 64 has a plurality of blades 78 attached to a hub and driven by a motor 80. As should be appreciated, a power source 68 is connected to motor 80 to operate the plurality of blades 78. Optionally, the fan 64 can direct airflow through vent opening 44 into cavity 40 of the hood. Alternatively, the fan 64 can direct airflow from the cavity 40 rearward through the vent opening 44 and into the surrounding environment. The housing for fan 64 is preferably rectangular in shape and preferably of substantially the same cross-sectional size as the vented area 76 in base 62. Alternate geometric shapes for the housing of fan 64 can be used as desired.

As illustrated in FIG. 7, protective cover 66 is preferably rectangular in shape and preferably of substantially the same cross-sectional size as fan 64. Alternate geometric shapes such as circular, oval, or square, to name a few for protective cover 66 can be used as desired. Protective cover 66 is attached to fan 64 in various ways. For example, protective cover 66 can be attached to fan 64 with a plurality of screws or other fasteners. Preferably, protective cover 66 is attached to the fan 64 with the fan attachment 72. Various materials may be used to form protective cover 66, such as, plastic, wood, or metal.

The base 62 preferably includes a power source 68 that connects to fan 64 to operate the plurality of blades 78. Preferably, the power source 68 is eight AA batteries stored in a battery holder. Preferably, the pocket 74 is sized to hold the power source 68 and a battery holder. As should be appreciated, power source 68 is preferably lightweight and compact so that it can be easily worn on the wearer's head. Optionally the power source 68 is one or more rechargeable batteries or a combination of rechargeable and non-rechargeable batteries. In another form, the power source 68 can be one or more batteries of different sizes and voltages. For example, power source 68 can be a C battery, a D battery, or any other voltage or combination of batteries. Preferably, the pocket 74 is sized to hold the desired sizes of the batteries. As should be appreciated, the power source 68 can be removed from the pocket 74 to allow the wearer to place an unused or recharged power source 68 or batteries into the pocket 74. Further, the wearer does not have to remove the base 62 from the hood 30 in order to remove or replace the power source 68.

Optionally, the base 62 includes fan guard 70. Fan guard 70 may be various geometric shapes as desired to cover fan 64. Fan guard 70 is preferably rectangular in shape and preferably of substantially the same rectangular cross-sectional size of fan 64. Fan guard 70 forms an arch over fan 64 and in this form, fan guard 70 defines a passageway 82. Preferably, the passageway 82 forms an intake pathway to direct inward airflow toward the fan 64. Optionally, the passageway 82 directs outward airflow from the fan 64 in a sideways direction away from the wearer as shown in FIG. 1. In an alternate configuration, the passageway 82 can direct the airflow in a vertical direction to or away from the wearer. For example, the passageway 82 can direct the airflow in a downward direction (FIG. 8). Optionally, fan guard 70 is sized to cooperate with rear flap 42. In this form, rear flap 42 covers the fan guard 70 as shown in FIG. 1. Rear flap 42 attaches to base 62 in various ways. For example, rear flap 42 can be attached to base 62 with a retaining strap or a Velcro® fastener. In this embodiment, rear flap 42 is preferably a longer length than the perimeter of fan guard 70.

As illustrated in FIG. 7, the fan assembly 60 preferably includes a switch 84 for turning the power source 68 on or off or adjusting the speed of fan 64. In one embodiment, switch 84 is mounted on pocket 74. As illustrated, switch 84 is a push-button mechanism. In other embodiments, the switch 84 can be a toggle, a knob, or a lever to name a few mechanisms.

In another preferred embodiment, hood 30 includes a light assembly 90 as illustrated in FIG. 2. In this form, light assembly 90 includes a light 92 and a battery 94 for operating the light 92. Alternately, light 92 is connected to power source 68. Light 92 is attached to front surface 34 of hood 30. Light 92 can be attached to front surface 34 with a clip or a Velcro® fastener, to name a few attachment mechanisms, to hold light 92 against front surface 34.

In an alternate embodiment, protective system 20 includes helmet 100 (as shown in FIG. 5) to rest on a wearer's head. In this embodiment, the cavity 40 of the hood 30 rests on the helmet 100. The helmet 100 can be a safety helmet.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A protective system, comprising:

a. a protective hood for surrounding corresponding areas of a wearer's head having at least front and rear portions, wherein said protective hood defines a vent opening in said rear portion;

b. a transparent shield mounted to said front portion of said protective hood;

c. a fan assembly having a fan, wherein said fan comprises a plurality of blades and a motor for rotating said plurality of blades in a path of movement so as to generate an airflow;

d. wherein said fan assembly is removably mounted to said protective hood to couple said fan to said vent opening to direct said airflow within said protective hood; and, e. a flap mounted on said rear portion of said protective hood, wherein said flap partially covers said fan to define a pathway for said airflow to or from said fan and wherein said flap is configured to seal said vent opening when said fan assembly is removed from said protective hood.

2. The protective system of claims 1, wherein said fan assembly includes a portion to direct said fan airflow in an inward direction toward said wearer when said fan assembly is mounted to said protective hood.

3. The protective system of claim 2, wherein said airflow is an outward airflow from said fan in a sideways direction away from said wearer when said fan assembly is mounted to said protective hood.

4. The protective system of claim 1, wherein said protective hood comprises an attachment means for mounting said fan assembly to said protective hood.

5. The protective system of claim 4, wherein said attachment means comprises a hook and loop engaging mechanism.

6. The protective system of claim 1, wherein said fan assembly includes a base removably mounted to said protective hood.

7. The protective system of claim 1, wherein said fan assembly includes a power source connectable to said motor for operating said fan.

8. The protective system of claim 7, wherein said fan assembly includes a pocket for storing said power source.

9. The protective system of claim 7, wherein said power source comprises at least one battery.

10. The protective system of claim 9, wherein said power source comprises a plurality of batteries.

11. The protective system of claim 1, further comprising a light assembly mounted on said front portion.

12. The protective system of claim 11, wherein said light assembly further comprises at least one battery connectable to said light assembly for operating said light assembly.

13. The protective system of claim 1, further comprising a helmet configured to rest on said wearer's head, wherein said protective hood is configured to be mounted over said helmet.

14. An adjustable protective system, comprising:

a. a protective hood for surrounding corresponding areas of a wearer's head having at least front and rear portions, said protective hood defining a vent positioned on said rear portion;

b. a transparent shield mounted to said front portion of said protective hood;

c. a fan assembly having a fan, said fan assembly selectively attachable to said vent to cause airflow within said protective hood; and d. a rear flap for selectively sealing said vent when said fan assembly is detached and for partially covering said fan when said fan assembly is attached to said protective to define a pathway for said airflow to or from said fan.

15. The adjustable protective system of claim 14, wherein said fan generates an airflow in an inward direction toward said wearer.

16. The adjustable protective system of claim 14, wherein said fan comprises a motor; and, wherein said fan assembly comprises a power source connectable to said motor for operating said fan.

17. The adjustable protective system of claim 16, wherein said fan assembly comprises a pocket to store said power source.

18. The adjustable protective system of claim 14, further comprising a helmet configured to rest on said wearer's head wherein said protective hood is configured to be mounted over said helmet.

19. The adjustable protective system of claim 14, wherein said airflow is an outward airflow substantially diverging from said fan.

20. A heat resistant protective system, comprising:

a. a hood defining a cavity for receiving a wearer's head, said hood having at least front and rear portions, and said hood defining an opening in said rear portion;

b. a transparent shield mounted to said front portion of said hood;

c. a fan assembly detachably mounted to said hood proximal to said opening, wherein said fan assembly includes a fan;

d. wherein said fan comprises a plurality of blades and a motor for rotating said plurality of blades in a path of movement so as to draw air into said hood;

e. wherein said fan assembly defines an intake pathway to direct said inward flow of air; and f. a rear flap for directing said intake pathway when said fan assembly is mounted to said hood and said rear flap is configured to seal said opening when said fan assembly is detached from said hood.

21. The heat resistant protective system of claim 20, wherein said fan assembly includes a power source.

22. The heat resistant protective system of claim 21, wherein said power source comprises at least one battery.

23. The heat resistant protective system of claim 22, wherein said fan assembly comprises a pocket to hold said power source.

24. The heat resistant protective system of claim 20, further comprising a helmet configured to rest on said wearer's head, wherein said protective hood is configured to be mounted over said helmet.

25. The heat resistant protective system of claim 20, wherein said motor rotates said plurality of blades in a path of movement so as to push air out of said intake pathway, said outward airflow substantially diverging from said fan.

26. A heat resistant protective system, comprising:

a. a heat resistant hood for surrounding corresponding areas of a wearer's head having at least front and rear portions, said heat resistant hood defines an opening in said rear portion;

b. a transparent shield detachably mounted to said front portion of said heat resistant hood;

c. a fan assembly mounted on said heat resistant hood proximal said opening, wherein said fan assembly includes a base and a fan;

d. wherein said fan directs a flow of air in an inward direction through said opening; and e. a flap mounted to said rear portion, wherein said flap extends at least partially over said fan assembly and said opening and wherein said flap defines a pathway for the flow of air.

27. The heat resistant protective system of claim 26, wherein said fan assembly comprises a power source stored on said base.

* * * * *